United States Patent [19]

Irie et al.

[11] 4,421,573

[45] Dec. 20, 1983

[54] METHOD FOR PRODUCING HOT-ROLLED DUAL-PHASE HIGH-TENSILE STEEL SHEETS

[75] Inventors: Toshio Irie; Toshiyuki Kato, both of Chiba; Isao Takahashi, Kurashiki, all of Japan

[73] Assignee: Kawasaki Steel Corporation, Hyogo, Japan

[21] Appl. No.: 394,999

[22] PCT Filed: Oct. 14, 1981

[86] PCT No.: PCT/JP81/00281

§ 371 Date: Jun. 9, 1982

§ 102(e) Date: Jun. 9, 1982

[87] PCT Pub. No.: WO82/01379

PCT Pub. Date: Apr. 29, 1982

[30] Foreign Application Priority Data

Oct. 14, 1980 [JP] Japan ..... 55-143435

[51] Int. Cl.[3] ..... C21D 8/02; C21D 9/46; C22C 38/34

[52] U.S. Cl. ..... 148/12 F; 148/12.4; 148/36

[58] Field of Search ..... 75/126 Q, 126 G, 123 C; 148/12 C, 12 F, 12.4, 36

[56] References Cited

U.S. PATENT DOCUMENTS 4,314,862 2/1982 Sudo et al. ..... 75/126 B
4,316,753 2/1982 Kaneko et al. ..... 148/36
4,325,751 4/1982 Josefsson ..... 148/12.4

*Primary Examiner*—Peter K. Skiff
*Attorney, Agent, or Firm*—Wenderoth, Lind & Ponack

[57] ABSTRACT

Dual-phase high-tensile steel sheets having a composite structure consisting of martensite and ferrite and a tensile strength of the order of 50-80 kg/mm$^2$ in an as-hot-rolled state are produced by a method which comprises preparing as a starting material a slab comprising 0.03-0.15% C, 0.5-1.0% Mn, 0.8-2.0% Si, 0.6-2.0% Cr, 0.01-0.1% Al, the balance being essentially Fe and accompanying impurities, heating said slab at a temperature of 1,050°-1,220° C., hot rolling the heated slab, completing the hot rolling at a temperature of 800°-900° C., thereafter cooling the hot-rolled sheet to a temperature of 350°-500° C., and winding the sheet into a coil at the latter temperature. A proper combination of the above-mentioned steel composition, slab heating temperature prior to hot rolling, final hot rolling temperature and winding temperature allows hot-rolled dual-phase high-tensile steel sheets having improved formability and uniform mechanical properties to be produced at a low cost without adding expensive Mo.

5 Claims, 5 Drawing Figures

METHOD FOR PRODUCING HOT-ROLLED DUAL-PHASE HIGH-TENSILE STEEL SHEETS

FIELD OF INVENTION

This invention relates to a method for producing dual-phase high-tensile steel sheets having improved workability and a composite metallic structure of ferrite and martensite phases, and more particularly, to a method for producing high-tensile steel sheets exhibiting a tensile strength of the order of 50–80 kg/mm$^2$ when measured on as-hot-rolled sheets.

DESCRIPTION OF PRIOR ART

For these years, high-tensile steel sheets having a dual phase structure consisting of ferrite and martensite phases have been commercially used as high-tensile steel sheets having excellent formability. It is well known that these dual-phase high-tensile steel sheets are produced either by hot rolling followed by continuous annealing or by hot rolling alone without annealing. Since the former method requires the annealing process with an increased production cost, greater attention is now being paid to the latter method, that is, a method for producing as-hot-rolled sheets.

A number of techniques were proposed to carry out the above-mentioned method for producing as-hot-rolled dual-phase high-tensile steel sheets, and it was found that slabs having certain alloying elements, Mn, Si, Cr and Mo added in proper combination should be hot rolled and wound into a coil at a controlled temperature. Except for the addition of Mo, all the previously proposed techniques have the problem that mechanical properties widely vary or are non-uniform in the longitudinal and width directions of produced coils when these techniques are commercially carried out. Those slabs having the above-mentioned alloying elements, particulrly Mo, are uniform in mechanical properties although the production cost of such slabs is undesirably increased as Mo is very expensive.

An object of this invention which has been achieved in consideration of the above-mentioned problems is to provide a method for producing dual-phase high-tensile steel sheets having uniform mechanical properties and a tensile strength of 50–80 kg/mm$^2$ in an as-hot-rolled state in a commercially acceptable manner without adding expensive Mo.

SUMMARY OF INVENTION

Making extensive experimental and research works in order to achieve the above-mentioned objects, the inventors have reached the following novel metallurgical findings.

In general, the formability of hot rolled steel sheets depends on their ductility and yield ratio (yield strength/tensile strength). The higher the ductility and the lower the yield ratio (not higher than 0.7, preferably not higher than 0.6), the better the formability is. In order to increase the ductility and reduce the yield ratio, it is desired that the fraction of bainite be as low as possible and the fraction of ferrite and martensite phases be as high as possible among the metallic phases of a sheet steel. In other words, it is desired that the sheet steel be of an ideal two phase structure consisting solely of ferrite and martensite as closely as possible. If austenite grains are coarse at the end of hot rolling, the transformation of austenite to ferrite during the subsequent cooling is retarded so that the proportion of bainite becomes higher when a hot-rolled sheet is cooled without any caution. It is thus believed that austenite grains are desirably as small as possible at the end of hot rolling in order to provide improved formability.

For the purpose of obtaining fine austenite grains as described above, according to the research work of the inventors, it is most effective to lower the heating temperature of slabs prior to hot rolling. More specifically, it has been found that the slab heating temperature should not exceed 1,220° C. as opposed to the conventional practice, that is, heating slabs to a temperature of not higher than 1,220° C. is essential. However, if slabs of a well-known composition are heated to relatively low temperature of not higher than 1,220° C. and continuously hot rolled, the hot rolling is completed at a considerably lower temperature. Unless rolled sheets are wound at a higher temperature without water cooling, recrystallization will not be completed and a deformed structure will remain, resulting in less ductile sheets having a high yield ratio. On the other hand, if rolled sheets are wound at a high temperature as indicated above, the austenite phase becomes unstable and no martensite phase is formed, and consequently the ferrite-martensite dual phase structure is not obtained, resulting in sheets susceptible to yield elongation in tension and having a high yield ratio. Consequently, it is difficult to obtain the desired properties from conventional slabs of a well-known composition even when the heating temperature prior to hot rolling is lowered to 1,220° C. or lower. Making further investigations on the composition of slabs, the inventors have found that an improvement in properties can be expected when slabs have a steel composition containing 0.5–1.0% Mn (all percents are % by weight), 0.8–2.0% Si and 0.6–2.0% Cr because heat is generated during working in a sufficiently increased quantity to maintain a higher temperature at the end of hot rolling even when the heating temperature prior to hot rolling is not higher than 1,220° C.

Furthermore, if the winding temperature after the hot rolling is low, for example, of the order of 200°–300° C., a dual phase structure consisting of ferrite and martensite is readily achievable in steels of common compositions. However, if sheets are quenched to a low temperature of the order of 200°–300° C. after hot rolling, the sheets show non-uniform mechanical properties and become unstable in configuration to such an extent that they are difficult to wind into a coil, and such steel sheets are difficult to level by means of a leveller or the like. It has been found that steels of the above-defined composition may be wound at a temperature of 350°–500° C. and that a dual phase structure consisting of ferrite and martensite is consistently available, mechanical properties become uniform at such winding temperature, and flat steel strips having little variance in mechanical properties are obtainable even in the case of a large-sized coil weighing 20 tons or more.

As described above, the inventors have first found that the heating temperature prior to hot rolling should be not higher than 1,220° C., have secondly found a proper composition of slabs allowing the above slab heating temperature to be applied in practice, and have thirdly found that slabs of such a composition may be wound at a winding temperature of 350°–500° C. to render the mechanical properties uniform; and have completed this invention on the basis of these three fundamental findings.

Accordingly, a method for producing a hot-rolled dual-phase high-tensile steel sheet according to this invention is characterized by preparing as a starting material a slab comprising 0.03–0.15% C, 0.5–1.0% Mn, 0.8–2.0% Si, 0.6–2.0% Cr, 0.01–0.1% Al, the balance being essentially Fe and accompanying impurities, heating the slab at a temperature of 1,050°–1,220° C., hot rolling the heated slab, completing the hot rolling at a temperature of 800°–900° C., thereafter cooling the hot rolled sheet to a temperature of 350°–500° C., and winding the sheet into a coil at a temperature within this latter range. This method allows an ideal dual-phase structure consisting of ferrite and martensite to be achieved when steel sheets are wound into a coil after hot rolling without the need for adding Mo, and hence, allows high-tensile steel sheets having low yield ratio, high ductility and remarkably improved formability to be produced at a low cost. As the winding temperature is as high as 350°–500° C., coiled steel strips have uniform mechanical properties and little configuration irregularity.

In the practice of the method of this invention, the cooling between the hot rolling and the winding may be carried out such that the hot rolled sheet is not forcedly cooled immediately after the completion of hot rolling until it reaches a temperature of 600°–700° C. and is then quenched at a cooling rate of 15°–80° C./sec. from such temperature to a winding temperature of 350°–500° C., resulting in steel strips having further improved yield ratio and ductility.

DETAILED DESCRIPTION OF INVENTION

First of all, the composition of slabs which can be used as a starting material to be subjected to hot rolling in the method of this invention is described. The slabs used herein comprise 0.03–0.15% C, 0.5–1.0% Mn, 0.8–2.0% Si, 0.6–2.0% Cr, 0.01–0.1%, Al, the balance being essentially Fe and accompanying impurities.

C is limited to the range of 0.03–0.15% because at least 0.03% should be present to provide the necessary strength while ductility and weldability are considerably deteriorated above 0.15%.

Figure 1:
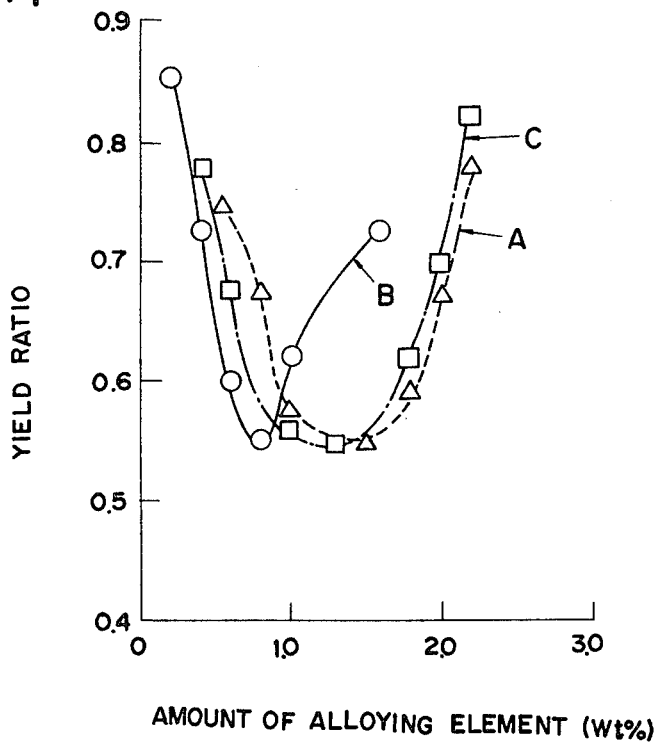
FIG. 1 is a graph showing the influence of Mn, Si and Cr on the yield ratio of hot-rolled steel sheets.

It was determined how Si, Mn and Cr affected yield ratio when slabs were rolled in a continuous hot rolling mill at a slab heating temperature of 1,150° C., a final hot rolling temperature of 850° C. and a coil winding temperature of 450° C., obtaining the results shown in FIG. 1. In FIG. 1, curve A corresponds to those steels of a basic composition of 0.08% C, 1.5% Mn and 1.3% Cr in which the amount of Si added is varied, curve B corresponds to those steels of a basic composition of 0.08% C, 1.5% Si and 1.3% Cr in which the amount of Mn added is varied, and curve C corresponds to those steels of a basic composition of 0.08% C, 1.5% Si and 0.8% Mn in which the amount of Cr added is varied. As seen from the curves in FIG. 1, the yield ratio exceeds 0.7 when Si less than 0.8%, Mn is less than 0.5%, or Cr is less than 0.6%. A ferrite-pearlite structure forms in any of these cases, and the dual phase structure of ferrite and martensite desired in this invention is not available. The yield ratio also exceeds 0.7 when Si is more than 2.0%, Mn is more than 1.0%, or Cr is more than 2.0%. This is because the proportion of martensite is increased and a bainite phase is additionally induced. Consequently, Si, Mn and Cr are limited to the ranges of 0.8–2.0%, 0.5–1.0% and 0.6–2.0%, respectively, in this invention.

Al is preferably used as a deoxidizing element and exerts its effect when added in amounts of 0.01% or more. Since more than 0.1% of Al results in an increase of undesired inclusions, Al is limited to up to 0.1%.

Furthermore, in the practice of the method of this invention, those slabs containing one or more elements selected from rare earth elements, Ca and Zr in an amount of 0.01–0.1% for each element in addition to the above-mentioned elements may be effectively used as the starting material for a further improvement in workability. The rare earth elements (REM), Ca and Zr which have a sulfide shape control effect contribute to an improvement in formability. The amounts of these elements added are limited to the above ranges for the reason that the sulfide shape control effect is not further improved and formability is rather deteriorated because of increased oxide inclusions when any of these elements is added in amounts of more than 0.1%. Also, those slabs having a controlled content of S of not more than 0.01% may be desirably used as the starting material for an improvement in formability.

Steels having the above-mentioned composition may be prepared by a conventional steel making process and slabs thereof may be produced either by ingot making followed by slabbing or by continuous casting.

Figure 2:
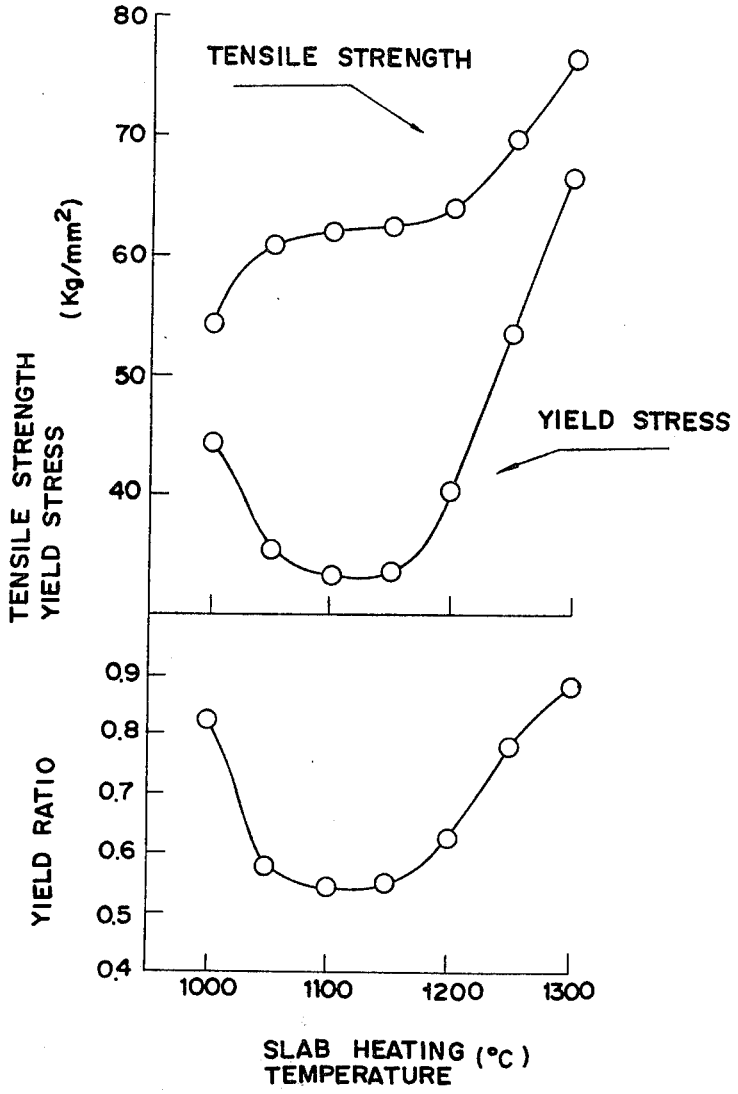
FIG. 2 is a graph showing the influence of the slab heating temperature prior to hot rolling on the tensile properties of hot-rolled steel sheets.

The rolling conditions which can be used in the method of this invention are now described. First, the slab heating temperature for hot rolling is limited to 1,050°–1,220° C. FIG. 2 shows how the tensile properties vary when slabs of a 0.07% C-1.5% Si-0.8% Mn-1.2% Cr steel are heated to varying temperatures of 1,000°–1,300° C., hot rolled in a continuous hot rolling mill, finish rolled at 850° C. and wound into a coil at 450° C. Bainite is incorporated into the structure to increase the yield ratio at heating higher than 1,220° C. whereas pearlite transformation takes place to increase the yield ratio at temperatures lower than 1,050° C. The heating temperature is limited to the range of 1,050°–1,220° C. since a dual phase structure consisting of ferrite and martensite is obtained and the yield ratio is reduced to 0.7 or less at temperatures within this range.

Figure 3:
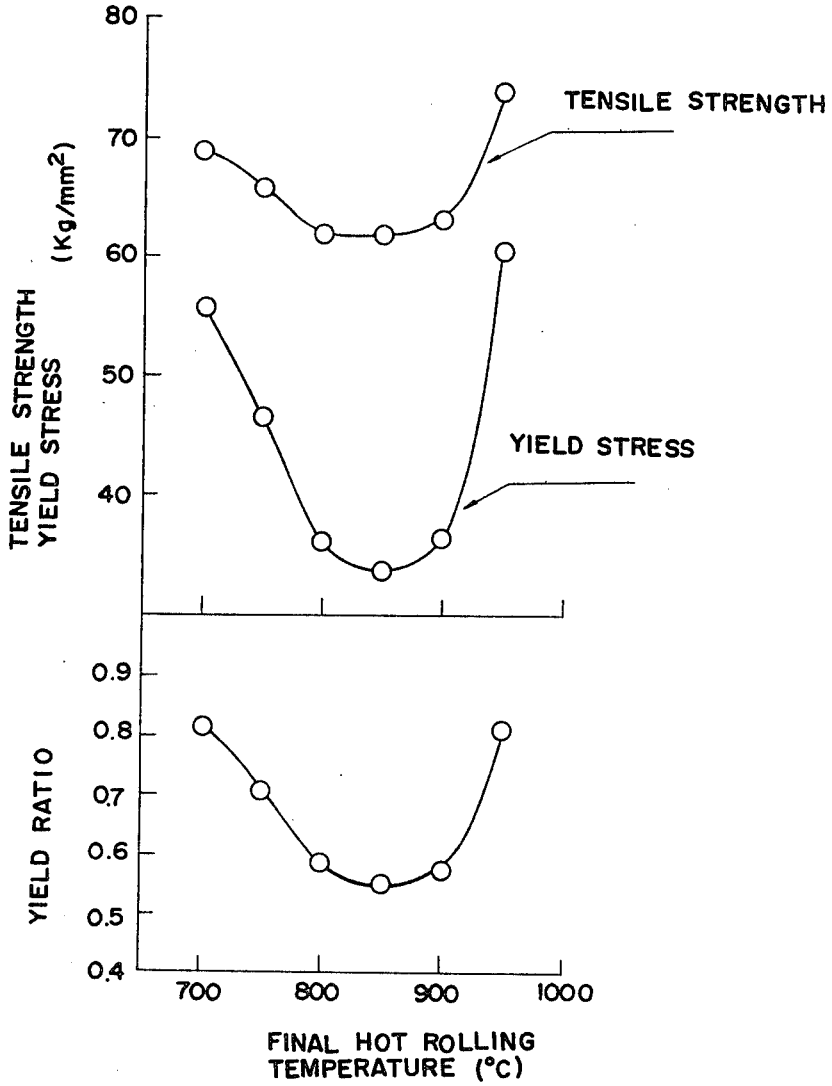
FIG. 3 is a graph showing the influence on the final hot rolling temperature on the tensile properties of hot-rolled steel sheets.

The final rolling temperature is limited to the range of 800°–900° C. FIG. 3 shows how the tensile properties vary when slabs of a 0.07% C-1.5% Si-0.8% Mn-1.2% Cr steel are heated to 1,150° C., hot rolled in a continuous hot rolling mill, finish rolled at varying final temperatures in the range of 700°–1,050° C., and wound into a coil at 450° C. Bainite appears and the martensite proportion is increased to increase the yield ratio at final hot rolling temperatures of 900° C. or higher, whereas the deformed structure remains with an increased yield ratio at final hot rolling temperatures of lower than 800° C. The final hot rolling temperature is limited to the range of 800°-900° C. because a dual phase structure consisting of ferrite and martensite is formed to provide a reduced yield ratio of 0.7 or less at temperatures within this range.

It was believed difficult in the prior art to maintain the final hot rolling temperature within the range of 800°-900° C. when a slab heated to a relatively low slab heating temperature of 1,050°-1,220° C. was continuously hot rolled into a thin steel sheet of 2-4 mm in thickness. It is, however, possible to keep the slab temperature at 800°-900° C. until the end of rolling despite the relatively low slab heating temperature, when slabs of the above specified composition according to this invention are used. Table 1 shows the upper limit of the final rolling temperature allowable when slabs of conventional Si-Mn steel and slabs of steel of this invention were hot rolled into a 2.6 mm thick sheet according to the same hot rolling schedule after they were heated to 1,100° C. As seen from Table 1, the above specified composition of steel according to this invention allows the final rolling temperature to be kept as high as 800°-900° C. in practice.

TABLE 1

| Composition | Upper limit of final rolling temperature |
|---|---|
| 0.05% C-1.0% Si-1.5% Mn-balance Fe | 780° C. |
| 0.05% C-0.8% Si-0.8% Mn-1.0% Cr-balance Fe | 840° C. |

Although it is not clearly understood why a difference develops between the steel used for the production of conventional as-hot-rolled dual phase high-tensile steel sheets and the steel used in the method of this invention, this difference is believed to result from the difference of recrystallization behavior of austenite during hot rolling.

Figure 4:
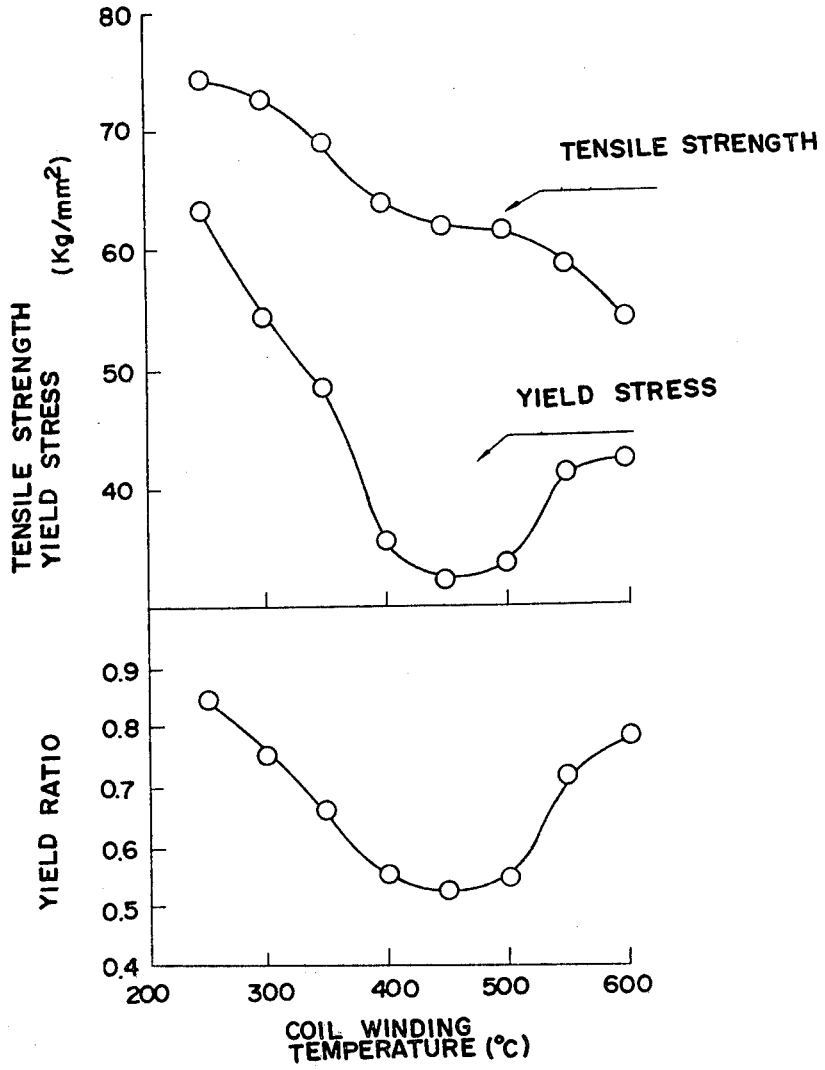
FIG. 4 is a graph showing the influence of the coil winding temperature on the tensile properties of hot-rolled steel sheets.

The coil winding temperature or the temperature at which a hot-rolled sheet is wound into a coil is limited to the range of 350°-500° C. FIG. 4 shows how the tensile properties vary when slabs of a 0.07% C-1.4% Si-0.8% Mn-1.3% Cr steel are hot rolled at a slab heating temperature of 1,150° C. and a final hot rolling temperature of 850° C. and then wound into a coil at varying winding temperatures. Since a pearlite structure develops at coil winding temperatures of 500° C. or higher and a ferrite-bainite structure develops at coil winding temperatures of lower than 350° C., the yield ratio exceeds 0.7 in either case. When the coil winding temperature is in the range of 350°-500° C., a dual phase structure consisting of ferrite and martensite desired in this invention is obtained with a reduced yield ratio of 0.6 or lower.

Figure 5:
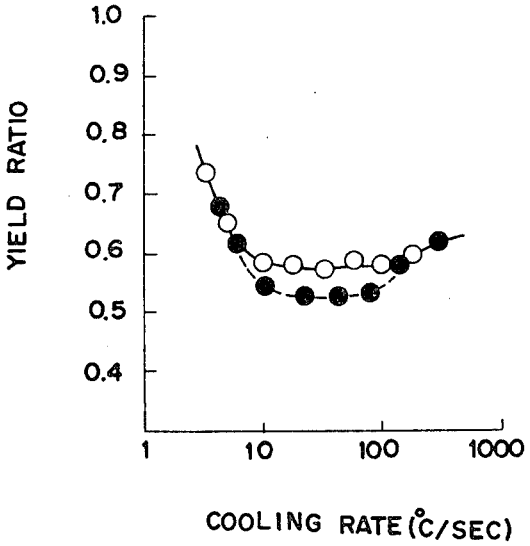
FIG. 5 is a graph showing the influence of the average cooling rate between the water cooling following hot rolling and the coil winding on the yield ratio of hot-rolled steel sheets.

Next, the conditions of cooling between the hot rolling and the coil winding are described. FIG. 5 shows the relationship of cooling rate to yield ratio when slabs of a 0.07% C-1.5% Si-0.8% Mn-1.2% Cr steel are heated at 1,150° C., hot rolled at a final hot rolling temperature of 850° C., cooled at varying rates, and then wound into a coil at 450° C. In FIG. 5, mark ○ corresponds to those slabs which were water cooled immediately after the completion of hot rolling and mark ● corresponds to those slabs which were not forcedly cooled immediately after the completion of hot rolling, but cooled to a temperature in the range of 600°-700° C. and then water cooled at the temperature of a run-out table (in this case, the cooling rate designates a cooling rate during the later water cooling from the temperature between 600° C. and 700° C.). As seen from FIG. 5, the former slabs which were water cooled immediately after the completion of hot rolling at a cooling rate (of 10°-200° C./sec.) available in an ordinary hot rolling mill had a yield ratio of 0.6 or lower. The latter slabs, which were not water cooled immediately after the completion of hot rolling, but were water cooled from the temperature in the range of 600°-700° C. at a rate of 15°-80° C. had a further reduced yield ratio. Consequently, in the practice of the method of this invention, although water cooling may be commenced immediately after the completion of hot rolling, it is desired for the purpose of further improving formability to carry out unforced cooling after the completion of hot rolling until a temperature of 600°-700° C. is reached and to carry out forced cooling from this temperature to the coil winding temperature at a rate of 15°-80° C./sec.

Examples of this invention are illustrated below together with Comparative Examples.

EXAMPLE 1

Steels having the compositions identified as sample Nos. I-VII in Table 2 were melt refined in a converter, cast into an ingot in a 20-ton mold, and slabbed into a slab having a thickness of 180 mm and a width of 1,020 mm. The slabs were heated to a temperature of 1,150° C. and then hot rolled into a 2.6 mm thick coil in a continuous hot rolling mill consisting of 4 stands of roughing rolls and 7 stands of finish rolls under the following hot rolling conditions:

| | |
|---|---|
| Final rough rolling temperature | 970° C. ± 20° C. |
| Slab thickness at the end of rough rolling | 32 mm |
| Final hot rolling temperature | 830° C. ± 20° C. |
| Initial water cooling temperature | 830° C. ± 20° C. |
| Coil winding temperature | 450° C. ± 20° C. |
| Average cooling rate between water cooling and coil winding | 40° C./sec. ± 5° C./sec. |

COMPARATIVE EXAMPLE 1

Steels having the compositions identified as sample Nos. VIII-X in Table 2 were melt refined, cast into an ingot and slabbed into a slab as described in Example 1, and then hot rolled under the same conditions as in Example 1.

Specimens (width 0.5 inches, gauge length 2 inches) for the API tensile test were cut from the hot rolled coils obtained in Example 1 and Comparative Example 1, in a direction perpendicular to the hot rolling direction. The results of the tensile test are shown in Table 2. As seen from Table 2, the specimens of sample Nos. I-VII falling within the composition range of this invention had a considerably low yield ratio of 0.5-0.6 and did not experience yield elongation in tension. On the contrary, the specimens of sample Nos. VIII-X having the content of Si, Mn or Cr falling outside of the composition range of this invention had a relatively high yield ratio and experienced yield elongation in tension. A comparison in tensile strength and elongation between sample Nos. I-VII and sample Nos. VIII-X in Table 2 reveals that the steels of Example 1 according to this invention exhibit a higher elongation than the steels of Comparative Example 1 at the same tensile strength, and hence, are more ductile than the latter.

EXAMPLE 2

Two hundred tons of a 0.06% C-1.6% Si-0.7% Mn-1.4% Cr steel was melt refined in a converter, and then cast into a 25-ton slab having a thickness of 200 mm and a width of 910 mm by a continuous casting process. The slabs were hot rolled in a continuous hot rolling mill consisting of 5 stands of roughing rolls, 7 stands of finish rolls and a water cooling equipment 130 mm in length into a 2.9 mm thick coil under the conditions shown for samples designated A–E in Table 3. The rough rolling was completed at a strip thickness of 33 mm.

COMPARATIVE EXAMPLE 2

The same slabs as used in Example 2 were hot rolled in the same hot rolling mill as used in Example 2 into a 2.9 mm thick coil under the conditions shown for samples designated F–H in Table 3.

Specimens (width 0.5 inches, gauge length 2 inches) for the API tensile test were cut from the hot rolled coils obtained in Example 2 and Comparative Example 2, in a direction perpendicular to the hot rolling direction. The results of the tensile test are shown in Table 4 together with the metallic structure of the specimens observed under an optical microscope.

As seen from Table 4, samples A–E of Example 2 which were hot rolled under the conditions as specified in this invention had a yield ratio of lower than 0.6 and did not experience yield elongation in tension. Particularly, sample C on which water cooling was started from 680° C. after the completion of hot rolling was further reduced in yield ratio among the others. On the contrary, samples F–H of Comparative Example 2 which were hot rolled under conditions outside of the range specified in this invention had a relatively higher yield ratio. The data of Table 4 also shows that the rolled strips prepared by the method of this invention exhibit a higher elongation than those of Comparative Example 2 at the same tensile strength. Furthermore, a ferrite-martensite structure was formed in all the rolled strips prepared in Example 2 of this invention whereas a bainite structure appeared, a deformed structure remained or a ferrite-pealite structure appeared in the rolled strips in Comparative Example 2.

TABLE 2

| | Sample No. | Chemical composition (% by weight) C | Si | Mn | Cr | Al | S | Other elements | Tensile properties: Yield stress (kg/mm²) | Tensile strength (kg/mm²) | Yield ratio | Total elongation (%) | Yield elongation (%) |
|---|---|---|---|---|---|---|---|---|---|---|---|---|---|
| Example 1 | I | 0.05 | 1.18 | 0.81 | 1.03 | 0.03 | 0.005 | — | 32.3 | 56.2 | 0.57 | 36 | 0 |
| | II | 0.07 | 1.20 | 0.74 | 1.28 | 0.04 | 0.011 | — | 33.5 | 62.3 | 0.54 | 33 | 0 |
| | III | 0.06 | 1.52 | 0.88 | 1.22 | 0.04 | 0.003 | — | 38.2 | 71.1 | 0.54 | 29 | 0 |
| | IV | 0.10 | 0.98 | 1.01 | 1.53 | 0.03 | 0.007 | — | 42.3 | 80.2 | 0.53 | 26 | 0 |
| | V | 0.07 | 1.22 | 0.76 | 1.25 | 0.04 | 0.011 | REM 0.031 | 34.2 | 62.5 | 0.55 | 35 | 0 |
| | VI | 0.07 | 1.21 | 0.74 | 1.26 | 0.04 | 0.011 | Ca 0.010 | 33.9 | 62.1 | 0.55 | 35 | 0 |
| | VII | 0.10 | 0.99 | 1.01 | 1.53 | 0.03 | 0.007 | Zr 0.038 | 42.8 | 81.0 | 0.53 | 27 | 0 |
| Comparative Example 1 | VIII | 0.05 | 0.29 | 0.81 | 1.03 | 0.03 | 0.005 | — | 40.5 | 50.6 | 0.80 | 34 | 1.4 |
| | IX | 0.07 | 1.20 | 0.41 | 1.28 | 0.04 | 0.011 | — | 47.3 | 58.1 | 0.81 | 32 | 2.4 |
| | X | 0.10 | 0.98 | 1.01 | 0.25 | 0.03 | 0.007 | — | 54.4 | 71.9 | 0.76 | 26 | 3.0 |

TABLE 3

| | Sample | Slab heating temperature (°C.) | Final hot rolling temperature (°C.) | Initial water cooling temperature (°C.) | Average cooling rate between water cooling and coil winding (°C./sec.) | Coil winding temperature (°C.) |
|---|---|---|---|---|---|---|
| Example 2 | A | 1180 | 870 | 870 | 33 | 480 |
| | B | 1150 | 830 | 830 | 30 | 450 |
| | C | 1150 | 830 | 680 | 68 | 450 |
| | D | 1150 | 800 | 800 | 42 | 390 |
| | E | 1100 | 800 | 800 | 26 | 430 |
| Comparative Example 2 | F | 1250 | 850 | 850 | 41 | 440 |
| | G | 1150 | 750 | 750 | 25 | 480 |
| | H | 1150 | 830 | 830 | 38 | 540 |

TABLE 4

| | Sample | Yield stress (kg/mm²) | Tensile strength (kg/mm²) | Yield ratio | Total elongation (%) | Yield elongation (%) | Structure* |
|---|---|---|---|---|---|---|---|
| Example 2 | A | 35.8 | 62.1 | 0.58 | 33 | 0 | F + M |
| | B | 34.5 | 63.5 | 0.54 | 31 | 0 | F + M |
| | C | 30.4 | 60.5 | 0.50 | 35 | 0 | F + M |
| | D | 38.4 | 66.5 | 0.58 | 30 | 0 | F + M |
| | E | 33.8 | 62.3 | 0.54 | 33 | 0 | F + M |
| Comparative Example 2 | F | 48.8 | 67.9 | 0.72 | 25 | 0 | F + B + M |
| | G | 50.3 | 66.8 | 0.75 | 22 | 0 | F + M (working structure) |
| | H | 42.3 | 55.4 | 0.76 | 32 | 1.8 | F + P |

*F:ferrite, M:martensite, B:bainite, P:pearlite.

INDUSTRIAL APPLICABILITY

The method of this invention is applicable to the production of high-tensile steel sheets which are mainly used in the manufacture of automobiles for improved safety and reduced vehicle weight. The method of this invention is best suited for the production of steel sheets which are to be press molded into automobile parts such as bumper parts and wheel parts which are required to have a low yield ratio and uniform mechanical properties. In addition, the method of this invention is also applicable to the production of steel sheets of which a variety of high pressure vessels are made.

We claim:

1. A method for producing a hot-rolled dual-phase high-tensile steel sheet having a structure consisting essentially of ferrite and martensite phases, which comprises preparing a slab comprising, by weight, 0.03–0.15% C, 0.5–1.0% Mn, more than 1%, up to 2.0% Si, 0.6–2.0% Cr, 0.01–0.1% Al, the balance being essentially Fe and accompanying impurities, heating said slab at a temperature of 1,050°–1,220° C., hot rolling the heated slab, completing the hot rolling at a temperature of 800°–900° C., cooling the resultant hot-rolled sheet to a temperature of 350°–500° C., and winding the sheet into a coil at the temperature of 350°–500° C.

2. A method according to claim 1, wherein, after the completion of hot rolling, the hot-rolled sheet is cooled to a temperature of 600°–700° C. in an unforced cooling manner and then quenched at a cooling rate of 15°–80° C./sec. from the temperature of 600°–700° C. the winding temperature of 350°–500° C.

3. A method according to claim 1 wherein, immediately after the completion of hot rolling, the hot-rolled sheet is forcedly cooled at a cooling rate of 10°–200° C./sec. until the winding temperature of 350°–500° C. is reached.

4. A method according to claim 1 wherein the slab further contains at least one element selected from the group consisting of 0.01–0.1% rare earth element, 0.01–0.1% Ca and 0.01–0.1% Zr.

5. A method according to claim 1 wherein the slab has a controlled content of S of not more than 0.01%.

* * * * *